US007435210B2

(12) United States Patent
Leupold et al.

(10) Patent No.: US 7,435,210 B2
(45) Date of Patent: Oct. 14, 2008

(54) ADJUSTING APPARATUS AND METHOD FOR A FOLDING-UNIT CYLINDER

(75) Inventors: Franz Leupold, Augsburg (DE); Franz Rumesz, Augsburg (DE); Peter Voelk, Ustersbach (DE)

(73) Assignee: Man Roland Druckmaschinen AG, Augsburg (DE)

( * ) Notice: Subject to any disclaimer, the term of this patent is extended or adjusted under 35 U.S.C. 154(b) by 72 days.

(21) Appl. No.: 11/180,120

(22) Filed: Jul. 12, 2005

(65) Prior Publication Data

US 2006/0014617 A1 Jan. 19, 2006

(30) Foreign Application Priority Data

Jul. 13, 2004 (DE) ..... 10 2004 034 047

(51) Int. Cl.
*B31F 1/08* (2006.01)

(52) U.S. Cl. ..... 493/424; 493/427; 493/432; 493/434

(58) Field of Classification Search ..... 493/428, 493/405, 424, 425, 426, 427, 429, 432, 356, 493/476

See application file for complete search history.

(56) References Cited

U.S. PATENT DOCUMENTS

| | | | | |
|---|---|---|---|---|
| 4,352,671 | A | 10/1982 | Petersen | |
| 4,437,855 | A * | 3/1984 | Bullen | 493/424 |
| 5,057,064 | A * | 10/1991 | Michalik | 493/8 |
| 5,201,701 | A * | 4/1993 | Roettger et al. | 493/425 |
| 5,443,437 | A | 8/1995 | Mack | |
| 5,507,714 | A * | 4/1996 | Furuta et al. | 493/475 |
| 5,846,177 | A | 12/1998 | Mayr | |
| 6,283,906 | B1 * | 9/2001 | Kostiza | 493/424 |
| 6,398,704 | B1 * | 6/2002 | Shibuya et al. | 493/424 |
| 6,896,648 | B2 * | 5/2005 | Fujinuma | 493/426 |
| 2002/0032109 | A1 | 3/2002 | Kostiza | |
| 2003/0096690 | A1 * | 5/2003 | Hachiya et al. | 493/424 |

* cited by examiner

*Primary Examiner*—Thanh K Truong
(74) *Attorney, Agent, or Firm*—Crowell & Moring LLP

(57) ABSTRACT

An adjusting apparatus and method for a folding-unit cylinder is disclosed. The apparatus includes a linkage which can be set longitudinally by an adjusting drive which is arranged in the folding-unit cylinder. An adjusting member is articulated on the output side of the linkage and is mounted so as to be rotatable about the axis of the folding-unit cylinder and actuates the members which guide folded products.

18 Claims, 6 Drawing Sheets

ADJUSTING APPARATUS AND METHOD FOR A FOLDING-UNIT CYLINDER

This application claims the priority of German Patent Document No. 10 2004 034 047.1, filed Jul. 13, 2004, the disclosure of which is expressly incorporated by reference herein.

BACKGROUND AND SUMMARY OF THE INVENTION

The invention relates to an adjusting apparatus for a folding-unit cylinder for actuating members which guide folded products.

The invention is based on the object of providing an adjusting apparatus of the generic type mentioned in the introduction, which adjusting apparatus can be set remotely and makes it possible to set members which guide folded products with the same basic structure in the circumferential direction of the folding-unit cylinder or in the radial direction.

According to the invention, this is achieved by a linkage which can be set longitudinally by means of an adjusting drive which is arranged in the folding-unit cylinder, and by an adjusting member which is articulated on the output side of the linkage, is mounted so as to be rotatable about the axis of the folding-unit cylinder and actuates the members which guide folded products.

A refinement of this type affords the further advantage that it is independent of the main drive of the folding-unit cylinder.

According to one refinement of the invention, the linkage has a rotatable spindle which is mounted so as not to be displaceable in the longitudinal direction and has an outer threaded part, the outer threaded part engaging into a threaded bush which is coupled to the adjusting member by means of a bolt. This refinement transfers the setting movement to a threaded connection. Extraordinarily sensitive setting is thus possible.

The adjusting drive preferably has an output shaft to which a bevel gear wheel is fitted which meshes with at least one further bevel gear wheel which is fitted onto a spindle, and the further bevel gear wheel drives the spindle. This results in a space-saving construction for transmitting the drive force to the spindle which can be set longitudinally.

For the purpose of supplying current to the adjusting drive, slip rings which are connected fixedly to the shaft of the folding-unit cylinder are advantageously provided and interact with current-conducting contacts which are attached to a fixed wall of the folding unit, and the current-conducting contacts are arranged such that they can be lifted off from the slip rings. This refinement prevents wear of the current-conducting contacts during operation of the folding-unit cylinder.

BRIEF DESCRIPTION OF THE DRAWINGS

Further features and advantages will be apparent from the description of three exemplary embodiments using the drawings, in which.

DETAILED DESCRIPTION OF THE DRAWINGS

Figure 1:
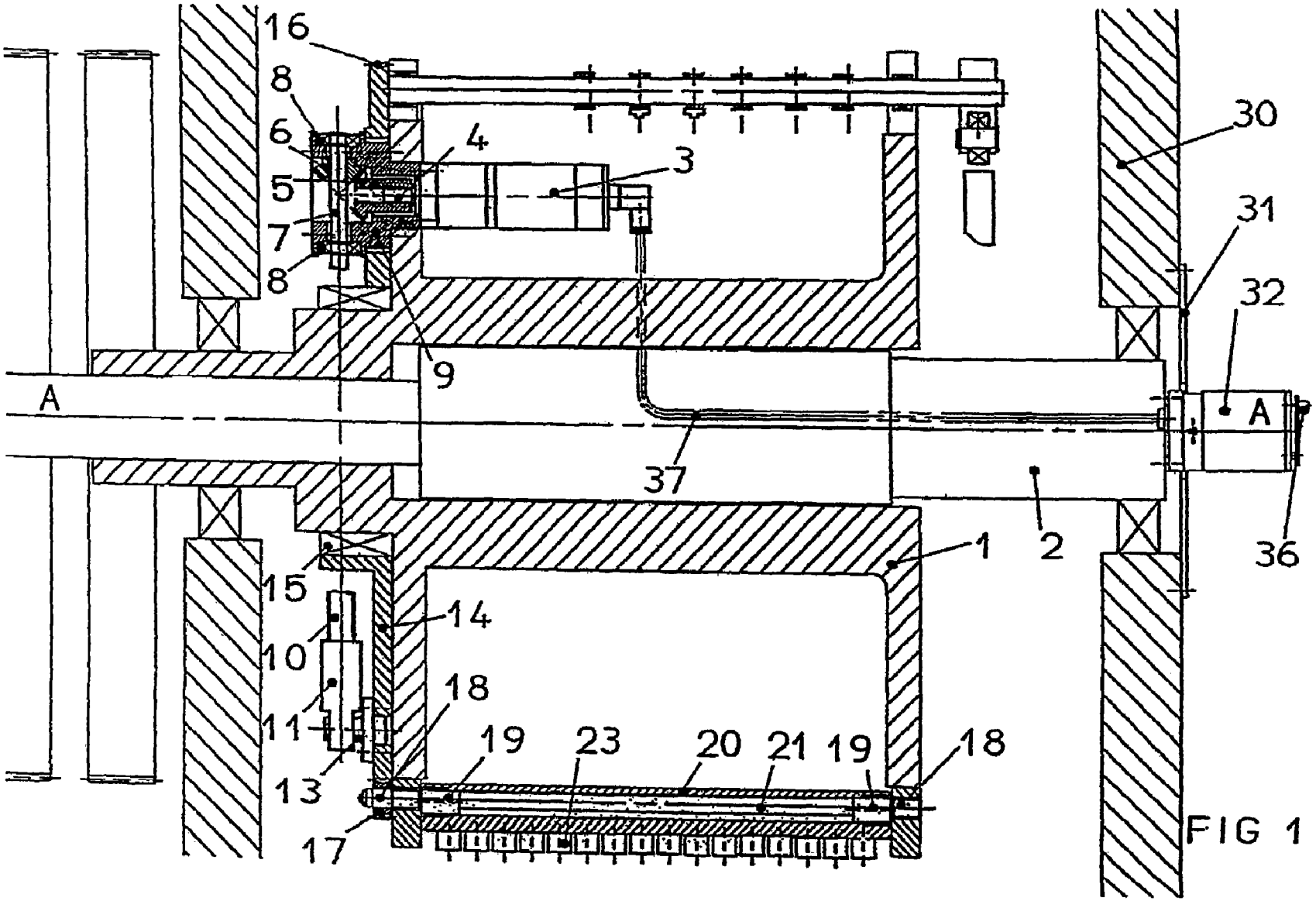
FIG. 1 shows a longitudinal section through a folding-unit cylinder.
Figure 2:
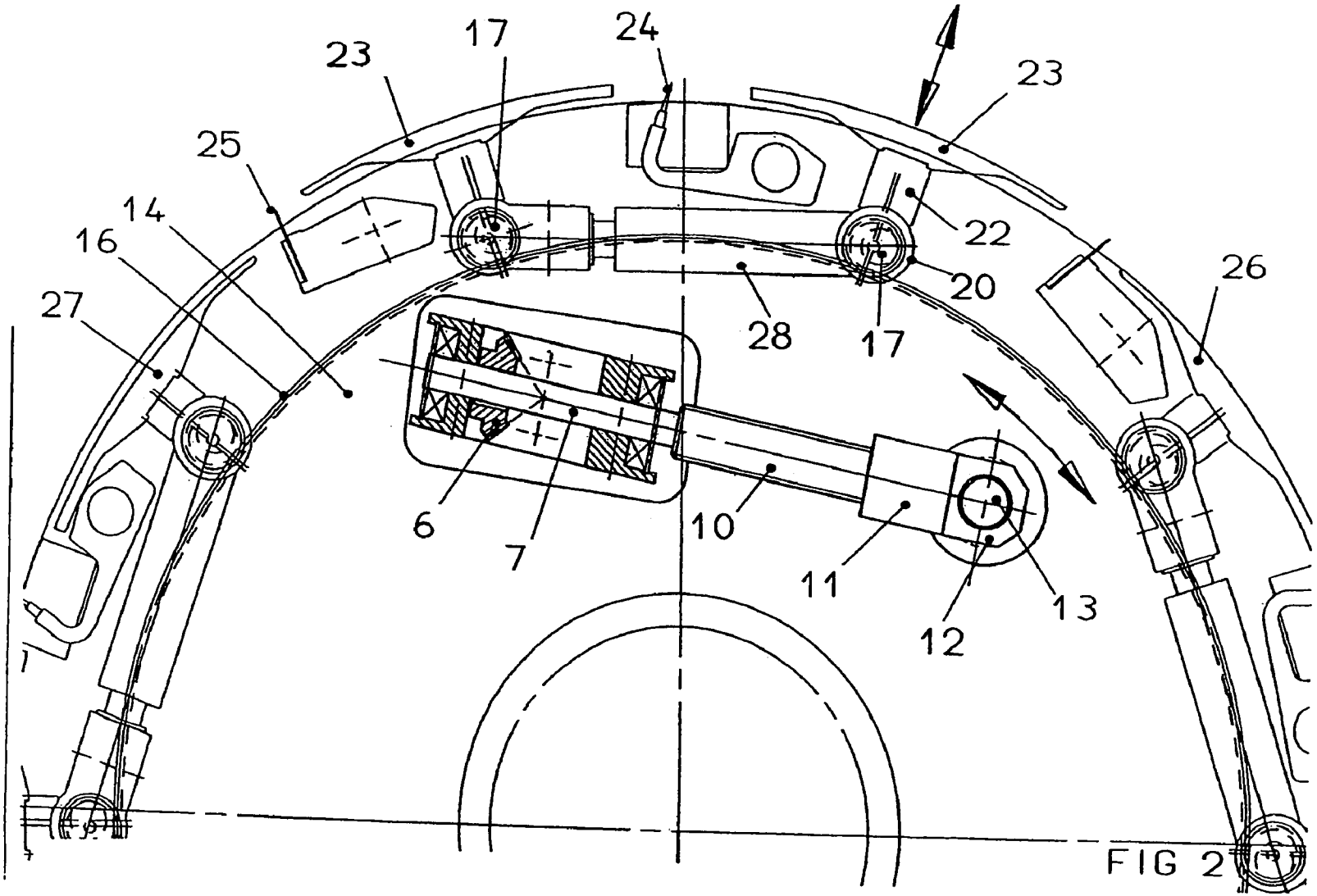
FIG. 2 shows an end view of a part of the cylinder according to FIG. 1.
Figure 3:
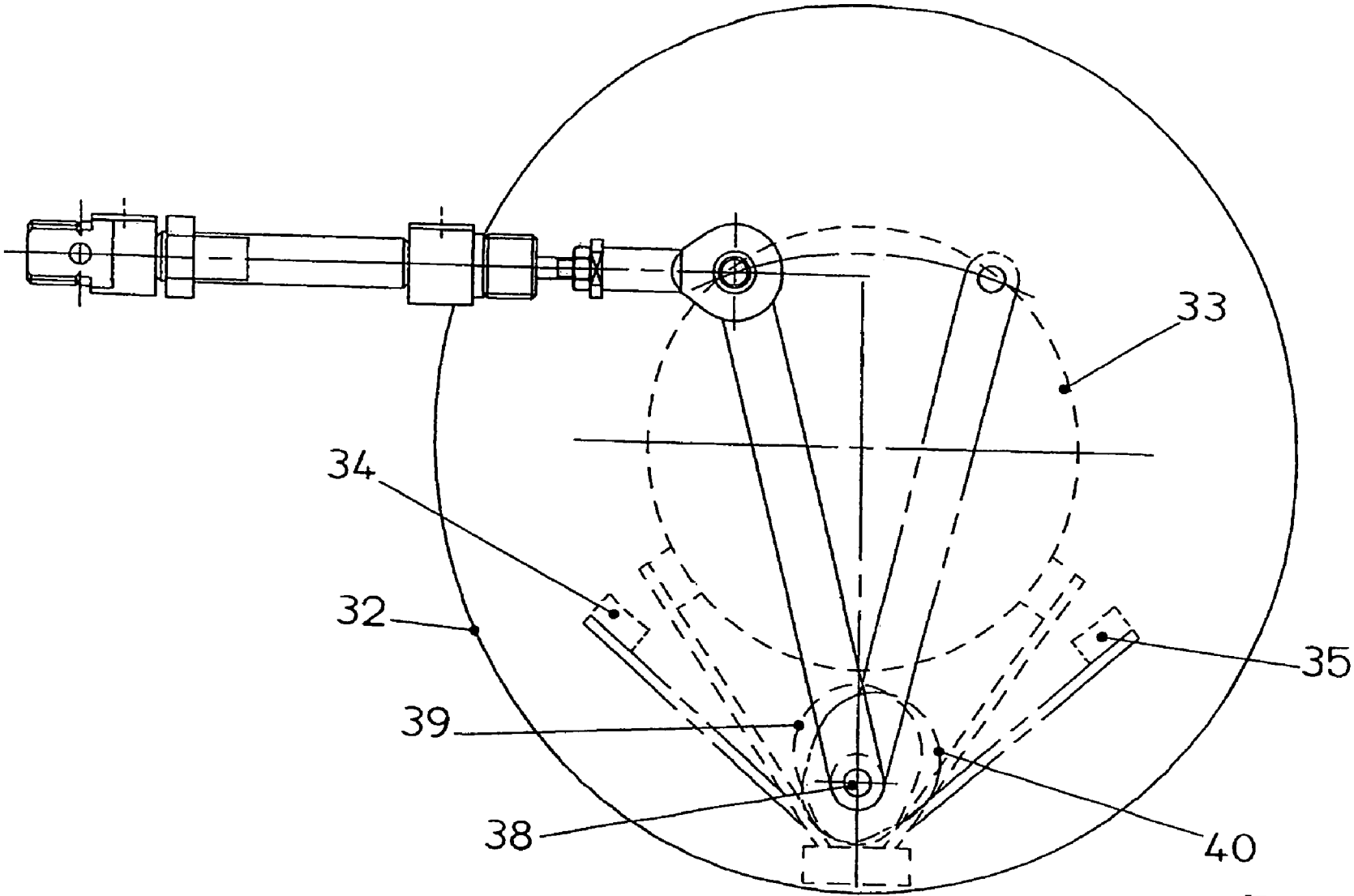
FIG. 3 diagrammatically shows an apparatus for switching off the current.

FIGS. 1 and 2 relate to a folding-unit cylinder which is configured as a gathering cylinder of the folding unit of a web-fed rotary press for newspaper printing.

In FIG. 1, the folding-unit cylinder is designated by 1 and the shaft which drives it is designated by 2. An adjusting drive 3 is installed fixedly within the folding-unit cylinder 1. The adjusting drive is configured here as an electric motor. A bevel gear wheel 5 is fitted fixedly onto an output shaft 4 of the adjusting drive 3. A further bevel gear wheel 6 which is fitted fixedly to a spindle 7 meshes with the bevel gear wheel 5. The spindle 7 is mounted so as to be rotatable but not displaceable in the longitudinal direction by means of two bearings 8 on a supporting bush 9 which is connected fixedly to the cylinder 1. The spindle 7 has an outer threaded part 10 which engages into a threaded bush 11. Here, the thread is of self-locking configuration. A projection 12 having a hole is provided on the threaded bush 11, into which hole a pin 13 engages. The parts 7 to 13 form a linkage for transmitting the setting movement, as can best be seen from FIG. 2. In FIG. 1, the parts 3 to 13 are shown moved into the sectional plane. The pin 13 is seated fixedly on an adjusting member 14 which is arranged on the cylinder 1 so as to be rotatable about its axis A-A by means of a bearing 15. The disc-shaped adjusting member 14 bears a crown gear 16 on its outer circumference. A number of pinions, for example 17, mesh with the crown gear 16. Every pinion 17 is seated on a shaft which is mounted on the cylinder 1 with shaft sections 18. Furthermore, the shaft has at least two eccentric shaft sections 19 which engage into a tubular support 20. A connecting section 21 is situated between the two shaft sections 19. A bar 22 which bears the circumference segments 23 is provided on every tubular support 20. The eccentric shaft sections 19 move the support 20 and thus the circumference segments in the radial direction as a result of the rotation of the shaft 18, 19, 21.

Moreover, perforating needles 24 and folding blades 25 are arranged between the circumference segments 23 in a manner known per se.

FIG. 2 shows the circumference segment 23 in its maximum radially outwardly extended position. This position serves to process very thin folded products, that is to say relatively small advertising papers, for example. In order to set the circumference segments to a position for folded products of normal thickness, as is indicated diagrammatically by the circumference segment 26, or for processing very thick folded products, as is indicated by the circumference segment 27, the adjusting drive 3 is switched on. The spindle 7 is then rotated via the bevel gear wheels 5, 6. This has the consequence that the outer threaded part 10 is screwed further into the threaded bush 11 and the length of the linkage is thus shortened. This movement is converted via the pin 13 into a rotational movement of the adjusting member 14. As a consequence of the crown gear 16 on the outer circumference of the adjusting member 14, the eccentric shaft sections 19 are rotated via every pinion 17 as a result. The circumference segment 23 is thus moved in the radial direction via the tubular support 20. As all the circumference segments 23 are arranged in the same way, the circumference of the folding-unit cylinder changes uniformly. The position of the circumference segments 26, 27 is thus indicated in FIG. 2 only in order to show the possible extent of a radial change of the diameter of the folding-unit cylinder.

In order to ensure that the tubular support 20 performs only a radial movement when the eccentric shafts 21 rotate, one end of a guide rod 28 is connected fixedly in each case to two adjacent tubular supports 20. Here, the guide rod 28 is of split configuration for installation, in order for it to be possible to set the exact spacing. However, other means can also be used for the rectilinear radial guidance of the circumference segments 23.

As the threaded connection between the threaded part 10 and the threaded bush 11 is of self-locking configuration, all the parts, in particular the circumference segments 23, remain in their position after the setting by the adjusting drive 3. The adjusting drive 3 therefore needs to be switched on only for a short period of time. It therefore remains switched off during operation of the folding-unit cylinder 1.

As the supporting bush 9 is connected on one side fixedly to the cylinder 1 and on the other side fixedly to the bearings 8, the adjusting member 14 is driven via the linkage 7 to 13 of the adjusting member 14 during operation of the folding-unit cylinder 1.

In order to supply current, a slip ring housing 32 is attached fixedly to a side wall 30 of the folding unit by means of supports 31, as shown in FIG. 1. The slip ring housing 32 accommodates a slip ring support 33 which is connected fixedly to the shaft 2. The slip ring support 33 has a plurality of individual slip rings which are separate from one another and lie behind one another in the axial direction. Every individual slip ring is assigned a current-conducting contact, for example 34, 35. The number of current-conducting contacts depends on the number of individual lines required. The current is supplied jointly to all the individual slip rings via a connection 36. The individual lines are combined and fed to the adjusting drive 3 via a collecting line 37 which is routed through the shaft 2 and the cylinder 1. In order to avoid constant grinding of the current-conducting contacts 34, 35 on the individual slip rings, the contacts 34, 35 are configured such that they can be disconnected from the individual slip rings. For this purpose, a shaft 38 with a plurality of eccentric cams 39, 40 is provided in the exemplary embodiment. The current conductors 34, 35 can be lifted off from the slip rings 33 by rotation of the shaft 38. During operation of the cylinder 1, the current supply is thus interrupted at this location, in order to avoid unnecessary wear of the current-conducting contacts 34, 35.

Figure 4:
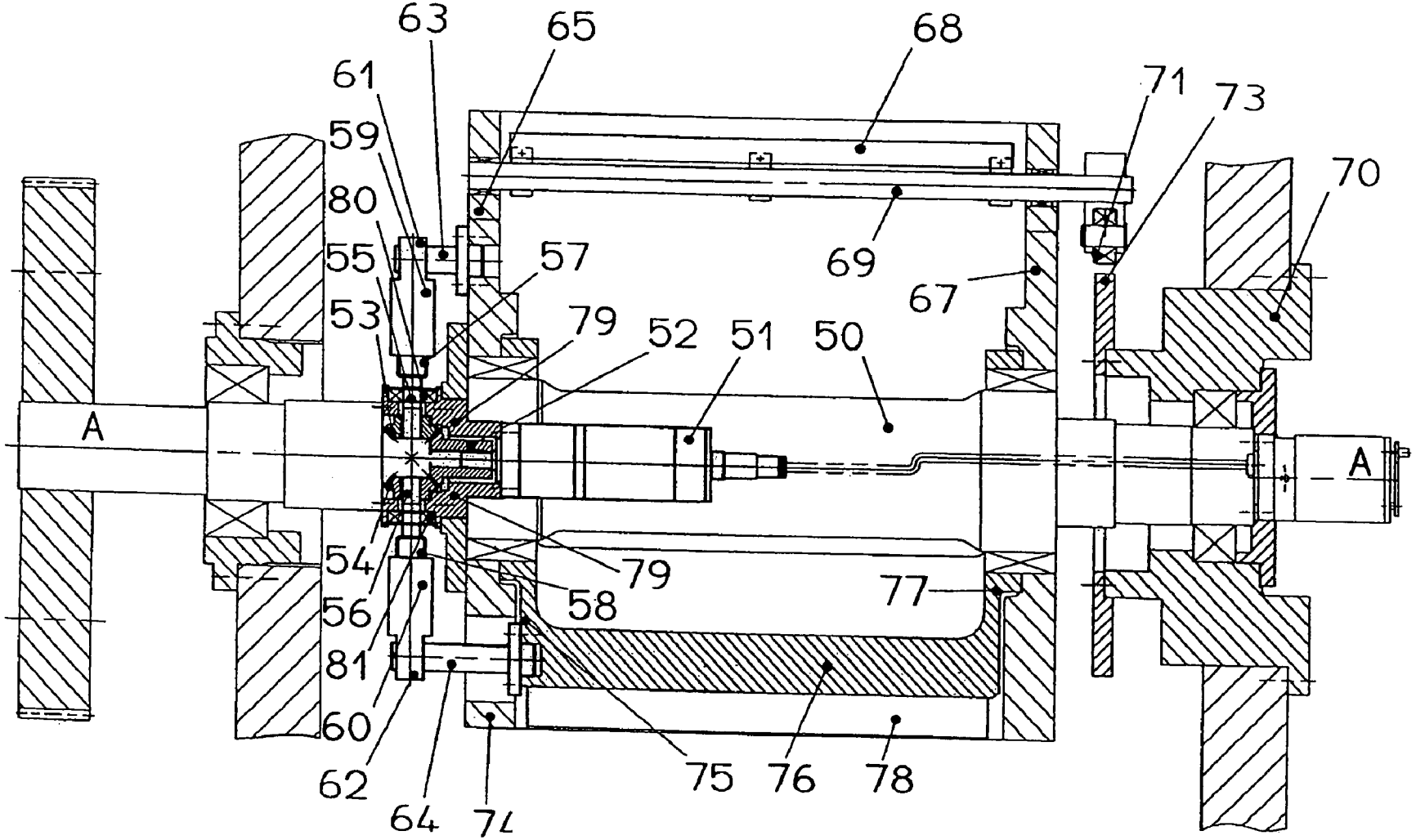
FIG. 4 shows a longitudinal section through a folding-unit cylinder of a second exemplary embodiment.
Figure 5:
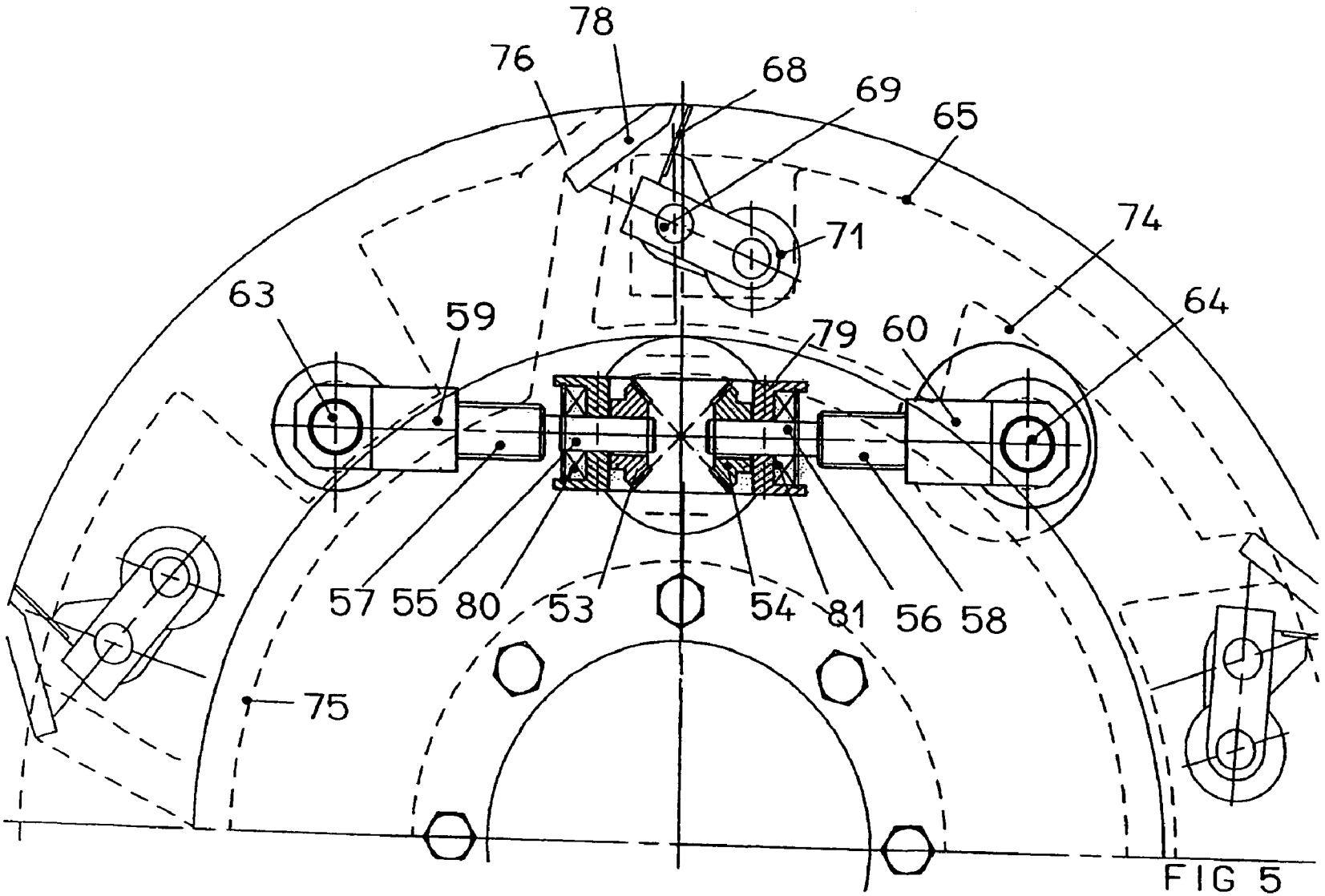
FIG. 5 shows an end view of parts of the cylinder according to FIG. 4.

FIGS. 4 and 5 relate to a folding-unit cylinder 50 which is configured as a folding-jaw cylinder and can again be preset for folded products of different thickness. An adjusting drive 51 is again attached fixedly to the cylinder 50, the bevel gear wheel 52 of the adjusting drive 51 meshing with two bevel gear wheels 53, 54. Every bevel gear wheel 53, 54 is seated on a spindle 55, 56 which is arranged so as to rotate but so as to be secured against longitudinal displacement, by means of in each case one bearing 80, 81. Every spindle 55, 56 bears an outer threaded part 57, 58 which is screwed into in each case one threaded bush 59, 60. Every threaded bush 59, 60 is provided with a projection 61, 62, a pin 63 and 64, respectively, engaging into the hole of the projection 61, 62.

The pin 63 is connected fixedly to a disc-shaped adjusting-member part 65 which is mounted so as to be rotatable about the axis A-A of the cylinder 50. The adjusting-member part 65 is connected fixedly via webs (not shown) to a further adjusting-member part 67 which is arranged at the other end of the cylinder 50. In each case one shaft 69 is mounted on the two adjusting-member parts 65, 67 for each movable folding jaw 68. Outside the adjusting-member part 67, the shaft 69 bears a roller 71 which interacts with a control cam 73 which is arranged on a side wall 70, in order to open and close the movable folding jaw 68.

The pin 64 penetrates an aperture 74 in the adjusting-member part 65 and is connected fixedly to a further adjusting-member part 75. The adjusting-member part 75 is connected to a further adjusting-member part 77 via at least one crossmember 76. Both adjusting-member parts 75, 77 are mounted so as to be rotatable about the axis A-A of the cylinder 50. Stationary folding jaws 78 are attached to the crossmember 76 during operation of the cylinder 50.

If the adjusting drive 51 is switched on, the bevel gear wheels 53, 54 are driven via the bevel gear wheel 52. The bevel gear wheels 53, 54 thus again rotate the spindles 55, 56 and thus their outer threaded parts 57, 58 which, depending on the rotational direction, are screwed into the threaded bushes 59, 60 or are screwed out of the latter somewhat. As a consequence of this movement, the pins 63, 64 and thus the adjusting members 65, 67 and 75, 77 are moved. As a result, the initial position of the movable folding jaws 68 and of the fixed folding jaws 78 is set in the circumferential direction of the folding-unit cylinder.

During operation of the folding-unit cylinder 50, the bearings 80, 81, the spindles 55, 56 and thus the two linkages are again driven via the supporting bush 79 which is connected to the cylinder. This rotational movement is transmitted via the pins 63, 64 to the actuating members 65, 67 and 75, 76, 77. During this movement, the movable folding jaws 68 are actuated via the roller 71 and the control cam 73 in a manner known per se.

Figure 6:
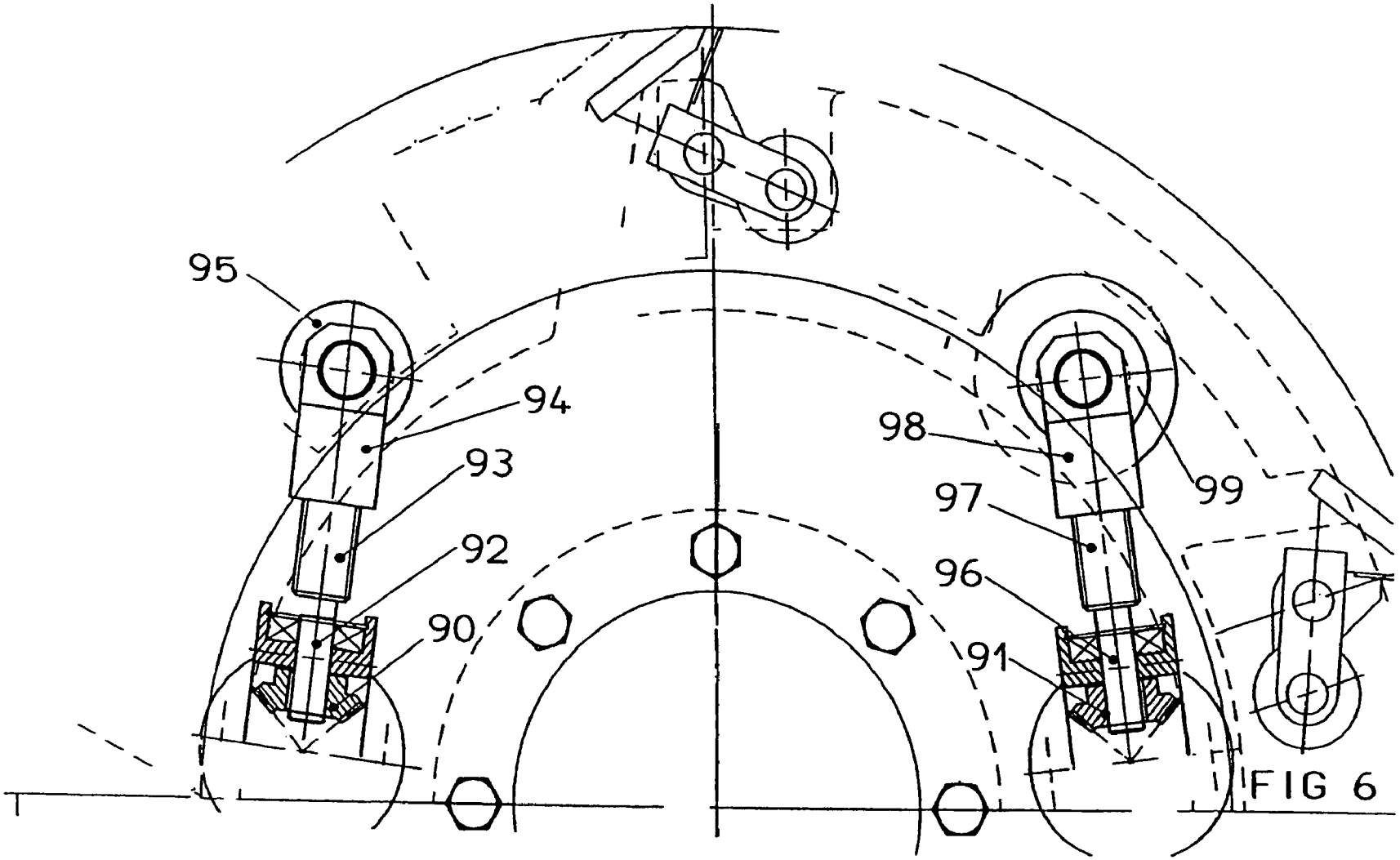
FIG. 6 shows an end view of a folding-unit cylinder of a third embodiment.

While an adjusting drive is provided in the arrangement according to FIGS. 4 and 5 for presetting the movable and fixed folding jaws, FIG. 6 shows that it is also possible to provide two adjusting drives for this purpose. Here, one adjusting drive acts on a bevel gear 90 and the other adjusting drive acts on a bevel gear 91. The bevel gear 90 drives a pin 95 for one actuator via the spindle 92, the threaded section 93 and the threaded bush 94. In the same way, the bevel gear 91 drives the pin 99 for the other actuator via the spindle 96, the threaded section 97 and the threaded bush 98. The further configuration coincides with the arrangement according to FIGS. 4 and 5. This arrangement makes individual setting possible both of the fixed and of the movable folding jaw.

The foregoing disclosure has been set forth merely to illustrate the invention and is not intended to be limiting. Since modifications of the disclosed embodiments incorporating the spirit and substance of the invention may occur-to persons skilled in the art, the invention should be construed to include everything within the scope of the appended claims and equivalents thereof.

What is claimed is:

1. An adjusting apparatus of a folding-unit cylinder for actuating members which guide folded products, comprising:

a linkage which is set longitudinally such that a length of the linkage defined by a first end of the linkage to a second end of the linkage is adjustable by an adjusting drive which is arranged in the folding-unit cylinder; and an adjusting member which is articulated on an output side of the linkage such that the adjusting member is rotationally driven by the linkage, is mounted so as to be rotatable about an axis of the folding-unit cylinder, and actuates the members which guide the folded products.

2. The adjusting apparatus according to claim 1, wherein the adjusting drive has an output shaft to which a bevel gear wheel is fitted which meshes with at least one further bevel gear wheel which is fitted onto a spindle, and wherein the further bevel gear wheel drives the spindle.

3. The adjusting apparatus according to claim 1, wherein the adjusting drive is configured as an electric motor.

4. The actuating apparatus according to claim 1, wherein the adjusting member is provided with an outer crown gear, wherein a pinion engages into the crown gear, and wherein the pinion drives a shaft which is mounted on the folding-unit cylinder with shaft sections, engages into a tubular support with eccentric shaft sections, and has a connecting section between the shaft sections, and further wherein the tubular support bears a member which is deployable radially to guide the folded products.

5. The adjusting apparatus according to claim 4, wherein the tubular support is connected fixedly to a second tubular support by a guide rod in order to secure the tubular supports against rotation.

6. The adjusting apparatus according to claim 4, wherein the member is configured as a circumferential section of a gathering cylinder.

7. The adjusting apparatus according to claim 1, wherein the adjusting member is connected fixedly to a member which is positionable in a circumferential direction and guides the folded products.

8. The adjusting apparatus according to claim 7, wherein the member which guides the folded products is configured as a fixed folding-jaw part.

9. The adjusting apparatus according to claim 1, wherein the adjusting member bears a pivot axis of a member wherein the member grips the folded products for guidance purposes.

10. The adjusting apparatus according to claim 9, wherein the member that grips the folded products is configured as a folding jaw.

11. An adjusting apparatus of a folding-unit cylinder for actuating members which guide folded products, comprising:

a linkage which is set longitudinally by an adjusting drive which is arranged in the folding-unit cylinder; and an adjusting member which is articulated on an output side of the linkage, is mounted so as to be rotatable about an axis of the folding-unit cylinder, and actuates the members which guide the folded products;

wherein the linkage has a rotatable spindle which is mounted so as not to be displaceable in a longitudinal direction and has an outer threaded part, wherein the outer threaded part engages into a threaded bush which is coupled to the adjusting member by a bolt.

12. The adjusting apparatus according to claim 11, wherein a threaded connection between the outer threaded part and the threaded bush is a self-locking configuration.

13. An adjusting apparatus of a folding-unit cylinder for actuating members which guide folded products, comprising:

a linkage which is set longitudinally by an adjusting drive which is arranged in the folding-unit cylinder;

an adjusting member which is articulated on an output side of the linkage, is mounted so as to be rotatable about an axis of the folding-unit cylinder, and actuates the members which guide the folded products; and a slip ring which is connected fixedly to a shaft of the folding-unit cylinder and which interacts with a current-conducting contact which is attached to a fixed wall of the folding unit, wherein the current-conducting contact is arranged such that it is movable off of the slip ring.

14. The adjusting apparatus according to claim 13, wherein a shaft is provided with a cam which moves the current-conducting contact off of the slip ring.

15. An adjusting apparatus of a folding-unit cylinder for actuating members which guide folded products, comprising:

a linkage which is set longitudinally such that a length of the linkage is adjustable by an adjusting drive which is arranged in the folding-unit cylinder; and an adjusting member which is articulated on an output side of the linkage, is mounted so as to be rotatable about an axis of the folding-unit cylinder, and actuates the members which guide the folded products;

wherein the linkage has a rotatable spindle which is mounted so as not to be displaceable in a longitudinal direction and has an outer threaded part, wherein the outer threaded part engages into a threaded bush which is coupled to the adjusting member by a bolt.

16. The adjusting apparatus according to claim 15, wherein a threaded connection between the outer threaded part and the threaded bush is a self-locking configuration.

17. An adjusting apparatus of a folding-unit cylinder for actuating members which guide folded products, comprising:

a linkage which is set longitudinally such that a length of the linkage is adjustable by an adjusting drive which is arranged in the folding-unit cylinder;

an adjusting member which is articulated on an output side of the linkage, is mounted so as to be rotatable about an axis of the folding-unit cylinder, and actuates the members which guide the folded products; and a slip ring which is connected fixedly to a shaft of the folding-unit cylinder and which interacts with a current-conducting contact which is attached to a fixed wall of the folding unit, wherein the current-conducting contact is arranged such that it is movable off of the slip ring.

18. The adjusting apparatus according to claim 17, wherein a shaft is provided with a cam which moves the current-conducting contact off of the slip ring.

* * * * *